US010357109B2

(12) United States Patent
Nose

(10) Patent No.: US 10,357,109 B2
(45) Date of Patent: Jul. 23, 2019

(54) UPHOLSTERED MODULAR FURNITURE ITEM

(71) Applicant: Braskem S.A., Camacari-BA (BR)

(72) Inventor: Guilherme Longa Nose, Sao Paulo (BR)

(73) Assignee: Braskem S.A., Camacari, BA (BR)

( * ) Notice: Subject to any disclaimer, the term of this patent is extended or adjusted under 35 U.S.C. 154(b) by 255 days.

(21) Appl. No.: 15/522,047

(22) PCT Filed: Oct. 29, 2015

(86) PCT No.: PCT/BR2015/050196

§ 371 (c)(1),
(2) Date: Oct. 16, 2017

(87) PCT Pub. No.: WO2016/065452

PCT Pub. Date: May 6, 2016

(65) Prior Publication Data

US 2018/0125241 A1 May 10, 2018

Related U.S. Application Data

(60) Provisional application No. 62/073,492, filed on Oct. 31, 2014.

(51) Int. Cl.

| | |
|---|---|
| ***A47C 7/24*** | (2006.01) |
| ***A47B 47/00*** | (2006.01) |
| ***A47C 4/02*** | (2006.01) |
| ***A47C 7/16*** | (2006.01) |
| ***A47C 13/00*** | (2006.01) |
| *A47C 5/12* | (2006.01) |

(52) U.S. Cl.

CPC ..... *A47C 7/24* (2013.01); *A47B 47/0091* (2013.01); *A47C 4/028* (2013.01); *A47C 7/16* (2013.01); *A47C 13/005* (2013.01); *A47C 4/022* (2013.01); *A47C 5/12* (2013.01)

(58) Field of Classification Search

None

See application file for complete search history.

(56) References Cited

U.S. PATENT DOCUMENTS

| | | | | |
|---|---|---|---|---|
| 5,988,749 | A * | 11/1999 | Williams | A47C 17/134 297/337 |
| 6,447,067 | B1 * | 9/2002 | Williams | A47C 4/021 297/184.11 |
| 6,688,699 | B1 | 2/2004 | Bowie | |
| 2008/0191538 | A1 | 8/2008 | Berg et al. | |
| 2008/0252130 | A1 | 10/2008 | Wieland et al. | |
| 2012/0187737 | A1 | 7/2012 | Blair | |
| 2014/0265513 | A1 * | 9/2014 | Lambert | B60N 2/0284 297/440.1 |

* cited by examiner

*Primary Examiner* — David E Allred
(74) *Attorney, Agent, or Firm* — Duane Morris LLP

(57) ABSTRACT

An upholstered modular furniture item (1) is described that is formed by a plurality of modular compositions substantially composed of polymeric material. The furniture item is configured such that the modular compositions can be combined with one another by means of at least one fitting element arranged in each one of the modular compositions so that different modular compositions have fitting elements with an interacting structural form for providing the combination of the modular compositions and formation of the modular furniture item (1).

15 Claims, 14 Drawing Sheets

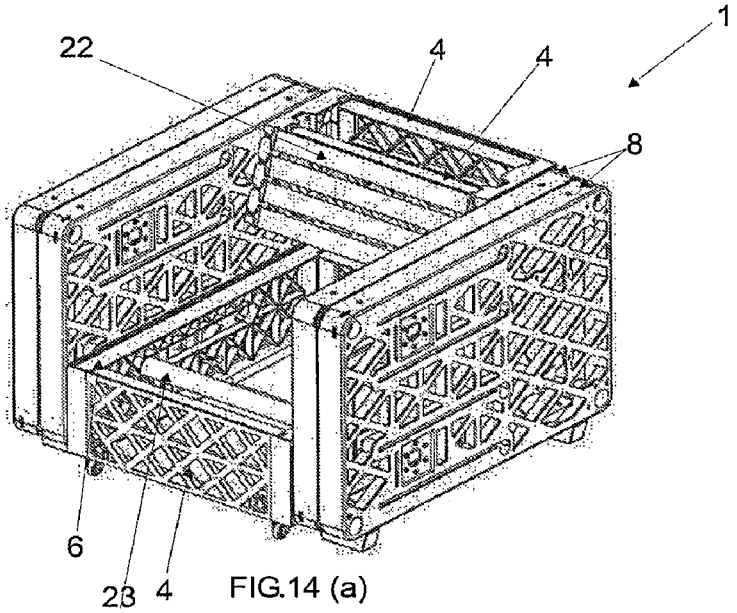
FIG.14 (a)
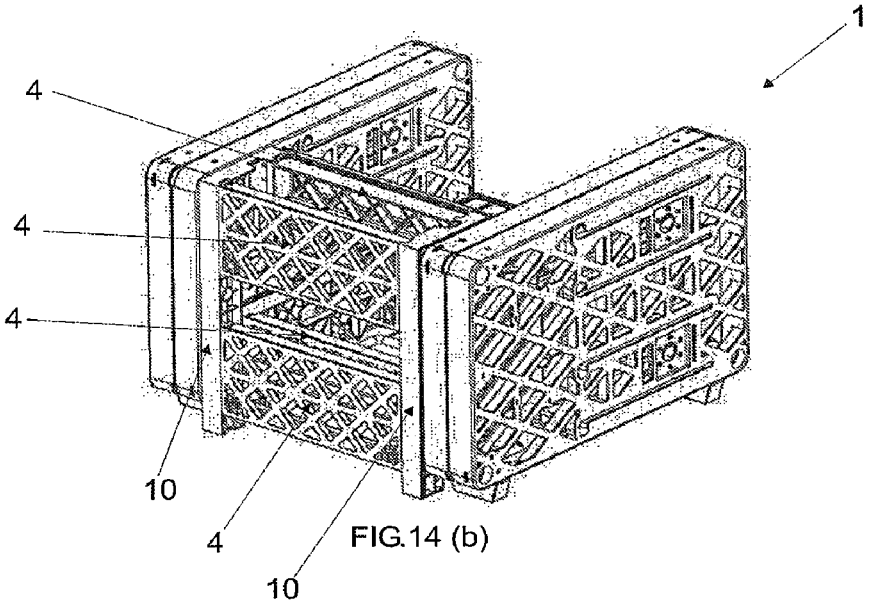
FIG.14 (b)
FIG.14

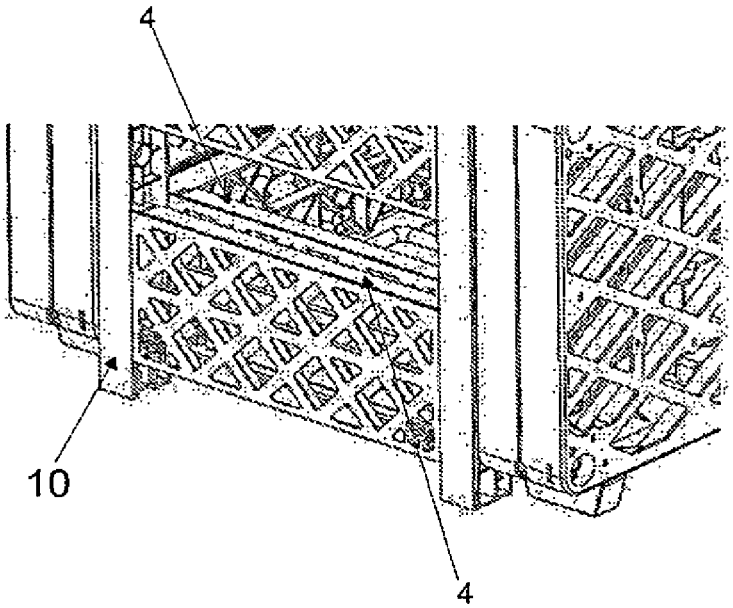
Fig. 17(a)
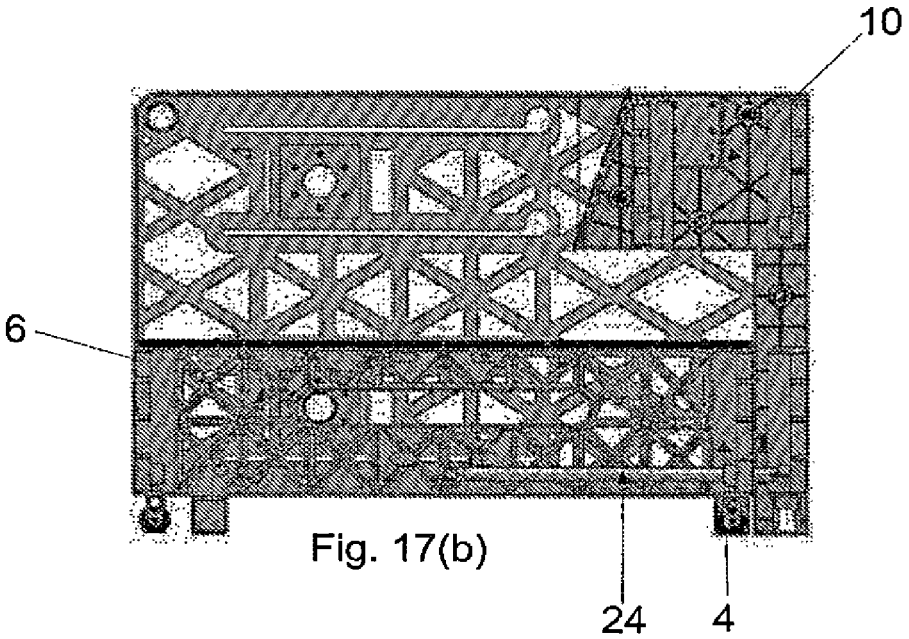
Fig. 17(b)
FIG.17

UPHOLSTERED MODULAR FURNITURE ITEM

The present invention refers to modular upholstered furniture, more precisely modular upholstered furniture made of polymeric material and equipped with a plurality of modular compositions that are easily associable with each other through a plurality of elements for fixing.

DESCRIPTION FOR THE STATE OF THE TECHNIQUE

Currently, the production process of the furniture industry (such as the production of sofas and armchairs) is essentially based on manual manufacturing and the main raw material used in the sector is wood.

The use of wood as an essential raw material, coupled with the specific characteristics of this material and the need for manual manufacturing, make the production of furniture a long process and in some cases dangerous to those in charge of it.

The need for drying the wood, the likelihood of accidents with splinters and staple guns, besides the large generation of shavings are exemplary characteristics of factors that prolong and hinder the current process used in the furniture industry.

The difficulties extend from the production to the transporting of the furniture to its point of sale, given that, having its main components fixed by means of staples that are difficult to remove, it must be transported fully assembled and using, in the majority of cases, large vehicles. Additionally, it is estimated that 60% of the volume of a finished sofa is composed of air, which makes logistics a key factor in the chain.

Also, transporting it from the point of sale to the place where the furniture will finally be delivered is equally laborious and costly to the owner, which is further complicated if the place of delivery is difficult to access, having, for example, narrow corridors, sets of ladders and lifts with restricted dimensions that often force the end client to use burdensome processes such as lifting loads, for the purpose of installing the piece in their dwelling, or commercial establishment.

As an alternative to the use of wood, the state of the technique discloses processes for producing plastic furniture by rotomolding. However, the furniture produced through this process is concentrated on pieces of conceptual design, little widespread and with greater aesthetic appeal than that of mass production.

Furthermore, the furniture produced by rotomolding is configured as large integral plastic blocks, which form the piece; in addition, the use of metal structures is common for the desired mechanical resistance to be achieved.

Thus, even if manufactured with plastic material, such furniture continues to exhibit the disadvantages and problems in wooden furniture, such as excessive weight and logistical difficulties.

The state of the technique further discloses some examples of plastic furniture formed by a number of interchangeable segments, as is the case of the matter disclosed in U.S. Pat. No. 8,684,466.

However, the fastening method used to provide the correct connection of the parts is inefficient, causing instability of the furniture when in use. This is evidenced by the need to use a metal band interconnecting different segments of the furniture so that adequate strength and stability are achieved.

The use of such a metal band is difficult to detect and, together with the inefficient fixing system disclosed in U.S. Pat. No. 8,684,466, they end up damaging the strength of the formwork for the plastic, easy-to-assemble furniture.

Thus, even when manufactured in plastic and having several segments connectable to each other, the furniture known in the state of the technique does not provide an efficient mode of fixation between the parts and still requires the use of metal elements in order to achieve the desired stability.

As seen above, modular furniture, made of polymeric material and which brings benefits to all of those involved in the production/distribution/sale/use chain of the furniture is not known in the state of the technique.

The proposed modular upholstered furniture is advantageous in the production process, guaranteeing an increase in productivity, greater standardization/dimensional regularity of the pieces, reduction in the waste of materials, reduction in workmanship, better quality control, greater ergonomics for the worker and also the use of recyclable material in place of wood.

The advantages with regard to the configuration and performance of the proposed modular furniture reside in gains in the freedom of design, mechanical resistance, resistance to humidity and the recyclability of the discarded product after its useful life.

In terms of the commercial sector, the advantages lie in the geographical expansion of the business due to the ease of creating new assembly lines in remote areas, a lower logistical cost with the possibility of better distribution of the pieces before putting the furniture together and greater occupation of the transport vehicles (lower unit freight cost per piece).

Furthermore, it becomes possible to trade in spare parts for each module of the furniture (avoiding the exchange thereof in full) and greater accessibility of the product by the ease of assembly for the final consumer.

Furthermore, the state of the technique does not disclose the modular furniture having an interlocking system between the easy-to-use parts and which promotes the desired sustainability and resistance for the furniture, thereby excluding the need for the use of metallic elements.

OBJECTIVES OF THE INVENTION

The present invention has as its objective the provision of modular upholstered furniture with its internal structure manufactured in polymeric material and provided with a plurality of modular compositions.

It is a further objective of the present invention to provide modular upholstered furniture in which the association between the modular compositions is carried out easily and intuitively by means of elements for fixing.

A further objective of the present invention is the provision of modular upholstered furniture, which may optionally be provided with a comfort extender thus allowing the displacement of its seat and increasing the comfort level of the user of the furniture.

The present invention also has as its objective the provision of modular upholstery that can be customized, thereby enabling the user to establish a modular furniture configuration according to their preferences. Changing the concept of upholstery from durable goods to consumer goods.

A further objective of the present invention is the provision of modular upholstered furniture, which allows the consumer to change the covering according to their taste and with changes in trends, or according to the wear and tear of the fabric that covers (envelops) the compositions of the proposed furniture.

BRIEF DESCRIPTION OF THE INVENTION

This describes modular upholstered furniture formed by a plurality of modular compositions substantially composed of polymeric material.

The furniture is configured so that the modular compositions are associable with each other by at least one fixing element available in each of the modular compositions, so that the distinct modular compositions have fixing elements the cooperate structurally to provide the association of the modular compositions and the formwork of the modular furniture.

Additionally, the proposed furniture allows its covering to be carried out by using at least one contact fastener and a closing element, enabling the user themselves to perform the changing of the covering when necessary, either for maintenance or to change the customization of the furniture.

BRIEF DESCRIPTION OF THE DRAWINGS

The present invention will hereinafter be more fully described based on a working example shown in the drawings. The figures show:

FIG. 14—Is a representation of the preferred configuration of the modular upholstered furniture proposed in the present invention, wherein FIG. 14 (*a*) is a front representation and FIG. 14 (*b*) is a rear representation;

FIG. 17—Is a sectional representation of the modular compositions to which the comfort structure is associated, in which FIG. 17 (*a*) highlights the posterior and lower portion of the modular furniture and FIG. 17 (*b*) is a side section representation of the modular furniture.

DETAILED DESCRIPTION OF THE FIGURES

Figure 1A:
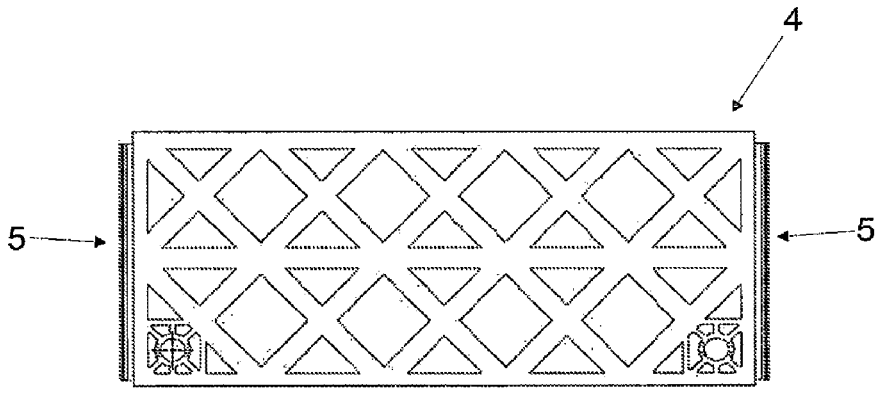
FIG. 1—FIG. 1 is a representation of the support base to be used in the proposed modular upholstered furniture, wherein FIG. 1 (*a*) shows a front view, FIG. 1 (*b*) is a perspective view and FIG. 1 (*c*) is a top view.

A preferred concretization of modular upholstered furniture 1 (also referred to as modular furniture 1) proposed in the present invention will now be described on the basis of the figures presented.

Initially, it should be pointed out that reference to modular furniture 1 should be understood as a sofa, armchair or any other furniture, whether it is of any size, and which is able to receive one or more pieces of upholstery for the proper use of the furniture.

Furthermore, modular furniture 1 proposed herein is not restricted to a particular target public or branch of specific use, and it can be used in residences, shops, summer houses, etc.

Proposed modular furniture 1 is made of polymeric material, thus, in this preferred configuration, the material used is polyolefin. In an alternative configuration, other materials/compounds could be used, such as recycled material or polyolefin compounds with glass-fiber.

This preferred configuration of modular unit 1 preferably comprises at least four modular compositions associable with each other, these are: a support base assembly 4, a pair of seat guides 6, a set of support brackets 8 and a pair of side rests 10.

The amount of modular compositions used for the formwork for modular furniture 1 may vary according to the client's desire; thus, the amount used for the description of this preferred configuration of the present invention should not be considered as a limiting character of proposed modular furniture 1.

Similarly, the dimensions described for each of the modular compositions and their components are to be understood only as preferred values, and do not result in any limitation on modular furniture 1 proposed in the present invention.

Figure 1B:
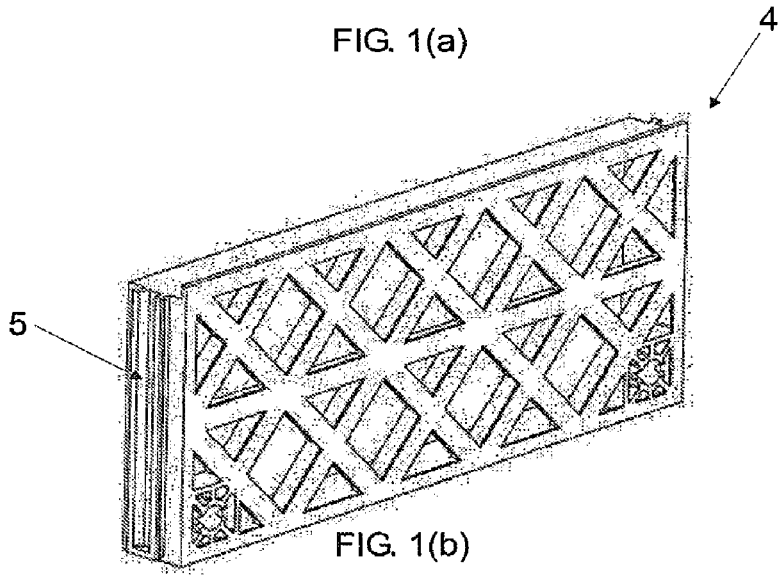
Figure 1C:
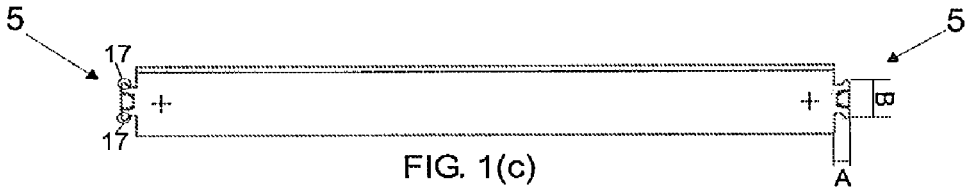

FIG. 1 is a preferred representation of support base 4 used in proposed modular furniture 1, wherein FIG. 1 (*a*) shows a front view and figure (*b*) is a perspective representation.

In a preferably rectangular configuration, where its length is at least twice the value of its height, and its thickness is approximately 10% the value of its length, support base 4 can be understood as the modular composition which, together with the seat guide 6 (to be described), promotes the correct support and support of the seat (upholstery) to be used in modular furniture 1.

For the composition of modular unit 1, at least one pair of support bases 4 must be used (such as a front and a rear base), with an identical structural configuration and dimensions.

In order to assemble modular furniture 1 and the correct fixing of its parts, each of the support bases 4 must comprise sliding projections 5 as best represented in FIG. 1 (*c*) of the present invention.

Sliding projections 5 are arranged along each of the sides with the smaller length of support base 4 extending substantially for all of the height of base 4.

In reference to FIG. 1 (*c*), configured as a collar "A" of approximately 10 millimeters from the lateral ends of support base 4, slide projections 5 comprise a contact surface B of approximately half the value of the thickness of the support base.

Starting from contact surface B towards the body of support base 4, it can be seen from FIG. 1 (*c*) that sliding projections 5 also establish a slight recess, thus configuring sliding teeth 17.

Figure 2A:
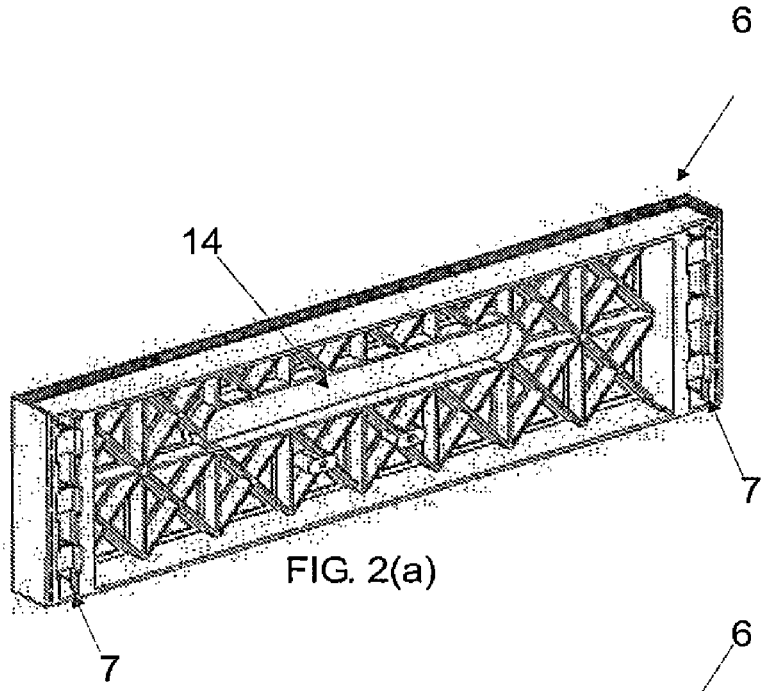
FIG. 2—Is a perspective view of a seat guide used in the modular upholstered furniture proposed in the present invention, wherein FIG. 2 (*a*) illustrates the portion of the seat guide facing the inner area of the modular furniture and FIG. 2 (*b*) illustrates its opposite portion.
Figure 2B:
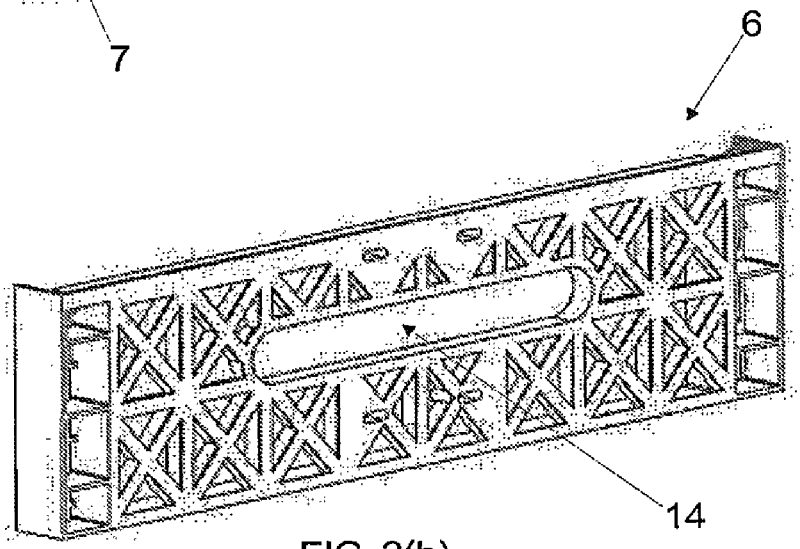

An additional composition of modular furniture 1 proposed in the present invention is represented in FIG. 2, such composition denominated as seat guide 6.

FIGS. 2 (*a*) and 2 (*b*) are perspective views of seat guides 6, so that FIG. 2 (*a*) mainly illustrates the portion of seat guide 6 which faces (is facing) an inner area of modular furniture 1, and FIG. 2 (*b*) mainly illustrates the portion of seat guide 6 which will be facing the outside thereof.

Of the height and thickness preferably equivalent to those of support base 4, in this preferred configuration of modular unit 1 seat guide 6 is endowed with a length of about four times the value of its height.

The number of seat guides 6 used in the assembly of modular furniture 1 will depend on the needs and desires of the client, so that in this preferred configuration of the present invention a pair of guides 6 is used.

Thus, due to their structural configurations and dimensions, seat guide 6 and support base 4 respectively operate as bases for accommodating the seat (upholstery) of modular furniture 1.

In this way, support base 4 can be understood as a "smaller" seat base and seat guide 6 as a "larger" seat base.

In reference to FIG. 2, the association between seat guides 6 and support bases 4 is achieved by means of sliding runners 7. As best seen from FIG. 2 (*e*), sliding runners 7 are arranged in the portion of seat guide 6, which faces the internal area of modular furniture 1.

Figure 3A:
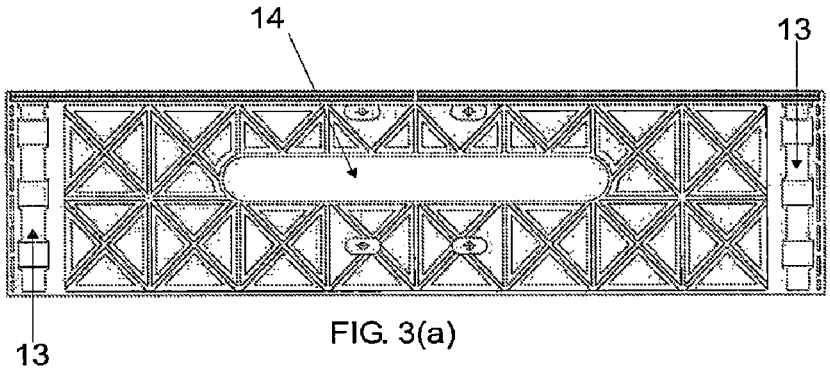
FIG. 3—Illustrates the seat guide shown in FIG. 2, wherein FIG. 3 (*a*) is a front representation and FIG. 3 (*b*) is a top representation.
Figure 3B:
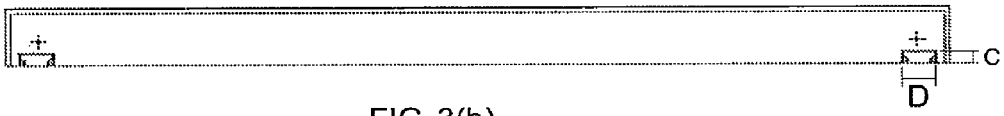

For a better understanding of the way in which the association between such parts occurs, FIG. 3 is a sectional illustration of seat guide 6.

More specifically, FIG. 3 (*a*) is a front view of seat guide 6 shown in FIG. 2 (*a*), showing the portion of guide 6 facing the interior of the furniture when assembling the latter.

It is noted from FIG. 3 (*a*) that each sliding runner 7 comprises a track 13 for fixing and displacing sliding projection 5 shown in FIG. 1. More specifically, track 13 of sliding runners 7 is apt to receive and allow the displacement of contact surface B and of sliding teeth 17.

As can be seen from FIG. 3 (*b*), sliding runners 7 are configured as slight cutouts, with a depth C of about 10 millimeters and a width D of about 30 millimeters.

Figure 4:
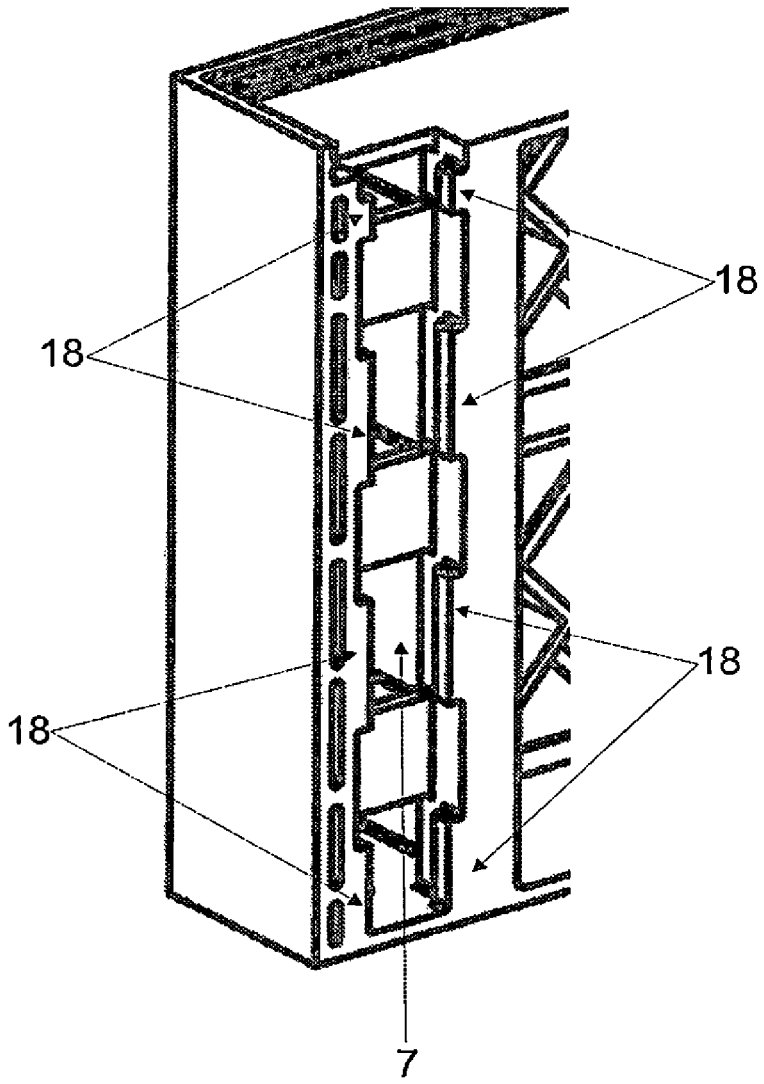
FIG. 4—Is a sectional representation of the sliding runner that exists on the seat guide.

Traversing the entire height of seat guide 6, and in reference to FIG. 4, sliding runner 7 further comprises a plurality of clamps 18, which establish along certain points of runner 7 widths slightly less than the total width of the runner and exposed in FIG. 3 (*b*).

Thus, the displacement of sliding projections 5, and more specifically of sliding teeth 17 through track 13 of sliding runner 7 and respective clamps 18 will establish the connection and attachment between support base 4 and seat guide 6.

Accordingly, by associating a pair of support bases 4 (such as a front one and a rear one) with a pair of seat guides 6 (such as a left one and a right one), the base structure of modular furniture 1 will be formed.

Depending on the client's needs, modular furniture 1 may optionally comprise an important feature, said feature shown in FIGS. 2 and 3 (*a*) and consisting of a comfort extender 14 preferably available on seat guide 6.

Comfort extender 14 is preferably configured as a longitudinally-profiled area available on seat guide 6 and thus allowing displacement of the seat (upholstery) to be used in modular furniture 1.

Thus, comfort extender 14 provides greater convenience and comfort to the user of modular furniture 1, allowing said furniture to acquire characteristics of conventional furniture made from wood, such as the displacement of its seat (chaise).

In order that seat displacement is possible, modular furniture 1 should further comprise a seat support structure (comfort structure), said structure to be described in detail below.

Figure 5:
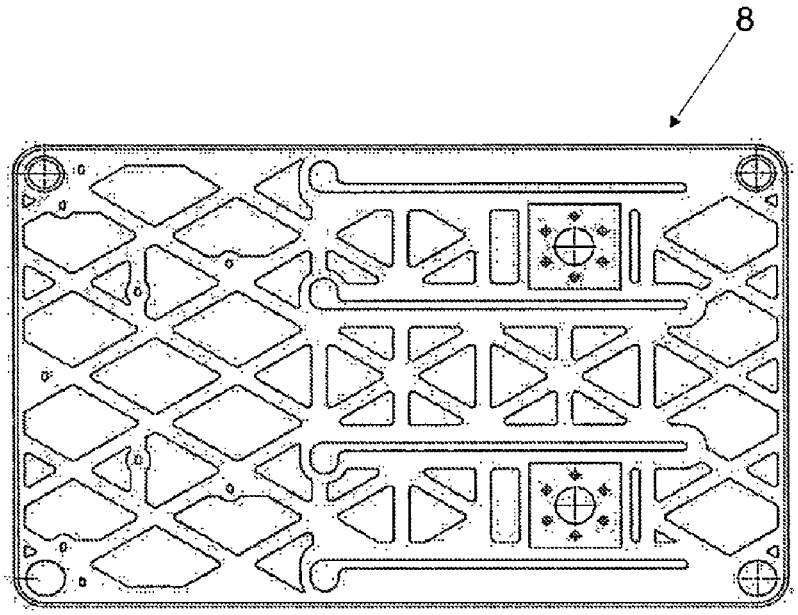
FIG. 5—Is a representation of the support bracket that integrates the proposed modular upholstered furniture, where FIG. 5 (*a*) is a frontal representation and FIG. 5 (*b*) is a perspective representation.
Figure 5:
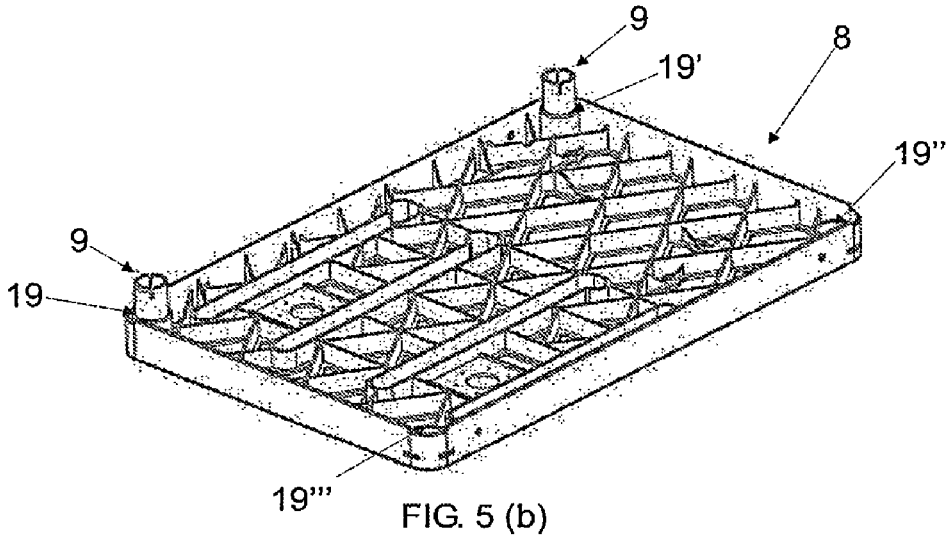
Figure 6:
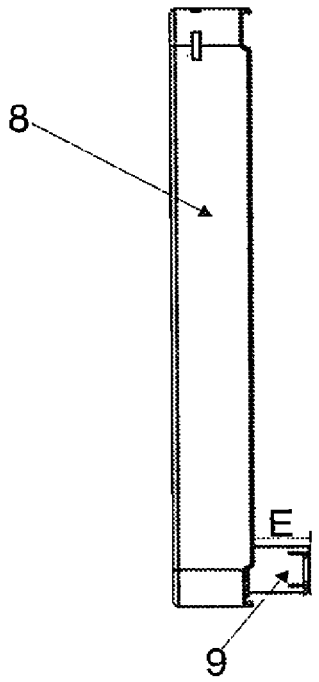
FIG. 6—Is an additional representation of the support bracket, now illustrating its side view.

In the following description of the compositions comprising modular furniture 1 proposed in the present invention, FIG. 5 is a representation of its support bracket 8.

More specifically, FIG. 5 (*a*) is a front view of support bracket 8, showing the portion of the bracket facing the outer surface of modular furniture 1, when giving the formwork its preferential configuration.

Having a preferred length equivalent to or about 10% greater than the length of seat guide 6, support bracket 8 laterally delimits modular furniture 1 when fully formed.

In this preferred configuration of modular furniture 1, support bracket 8 has a height of about 30% greater than half of its total length.

Furthermore, as best seen from FIG. 5 (*b*), support bracket 8 comprises a set of fixing collars 9 to provide the association between each support arm 8 on one side of proposed modular furniture 1. The association of support brackets 8 with the other compositions of the modular furniture will be better described below.

In this preferred configuration of support bracket 8 and modular furniture 1, two fixing collars 9 are used, which are provided with the same structural configuration.

Preferably, fixing collars 9 should be available at two of the four ends 19, 19', 19" and 19'" of support bracket 8. In this preferred configuration of the present invention, and as shown in FIGS. 5 (*b*) and fixing collars 9 are available at ends 19 and 19' and comprise a preferred length E of 50 millimeters.

It should be noted that the number and dimensions of fixing collars 9 exposed and described represent only one configuration of the invention, not leading to a limitation thereof.

In this preferred configuration of the present invention, a pair of support brackets 8 are used at each lateral end of modular furniture 1.

However, a greater amount of support brackets 8 could be used, depending only on the needs and desires of the client.

The connection between support brackets 8 of the same end occurs through the association of fixing collars 9 for one of brackets 8 with the ends of the other bracket 8, which does not comprise fixing collars 9.

Figure 7:
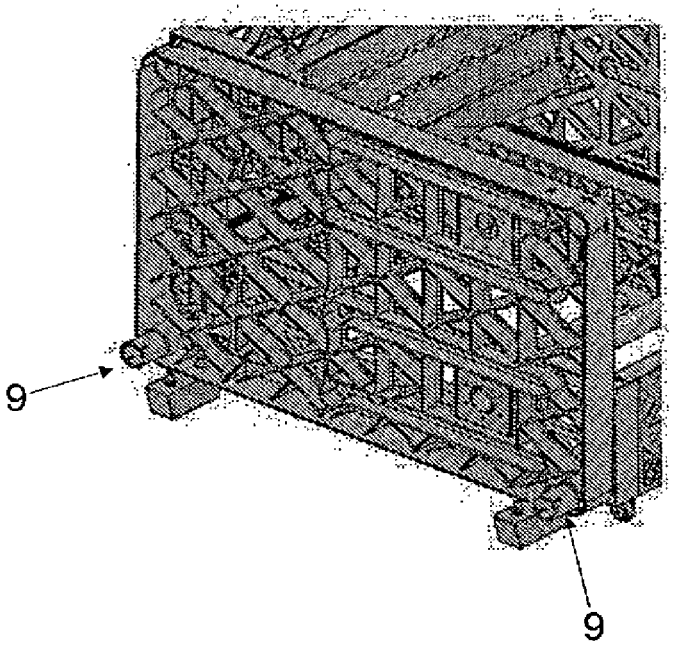
FIG. 7—Is a representation of one end of the modular upholstered furniture illustrating the use of only one support bracket.

For a better understanding, FIG. 7 is a representation of one end of the modular furniture comprising only one support bracket 8. Note the arrangement of fixing collars 9 suitable for association with the ends of the additional bracket, which does not comprise said collars.

Figure 8:
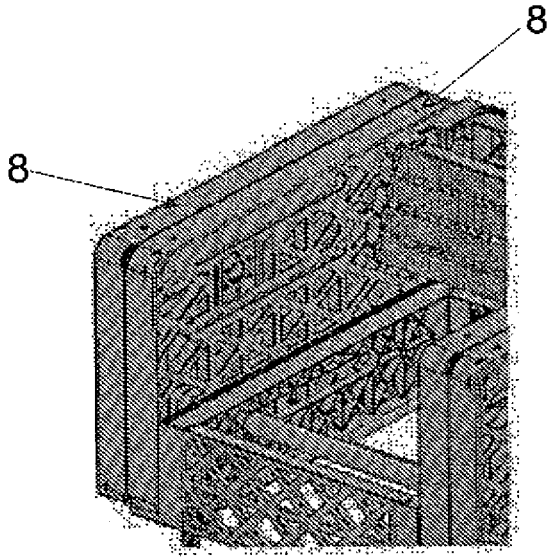
FIG. 8—Is a representation of one end of the modular upholstered furniture illustrating the use of two support brackets.

With additional support bracket 8 in place, the lateral end of modular furniture 1 will assume a configuration as shown in FIG. 8. Thus, the user of modular furniture 1 has the freedom to use the number of brackets 8 that they desire, thereby aesthetically configuring modular furniture 1 that suits them best.

Figure 9:
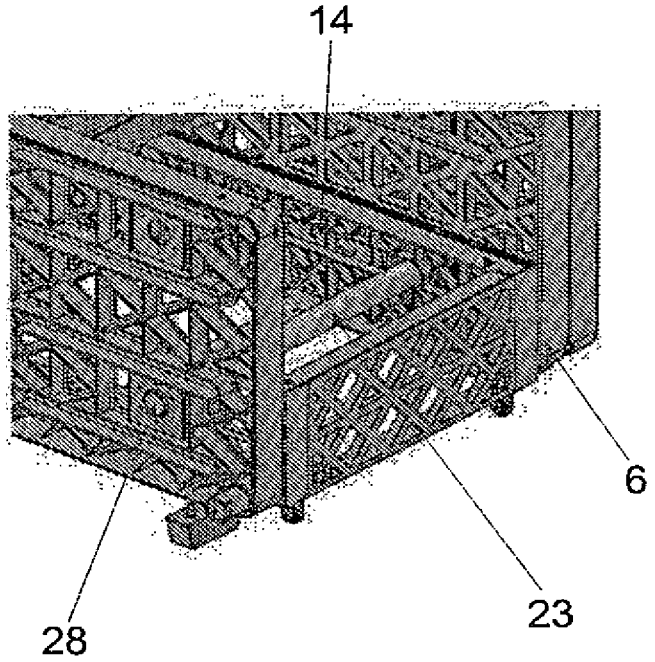
FIG. 9—Is a representation of the support bar to be used in the proposed modular upholstered furniture.

In reference to FIG. 9, and in order to prevent an undesired side opening in modular furniture 1, two opposing support brackets 8 should be interconnected, i.e., support brackets 8 arranged on each side of the modular furniture.

Thus, and preferably, a support bar 23 should be associated with the innermost support brackets 8 on each side of the modular furniture, as shown in FIG. 9.

Preferably made of polymeric material, it is noted that support bar 23 crosses seat guides 6 and respective comfort extenders 14, to then be attached to a coupling point 28 available on each one of brackets 8. Additionally, and preferably, fixing elements, such as plastic screws, may be used to potentiate the fixing of bar 23 to each one of support brackets 8.

Figure 10:
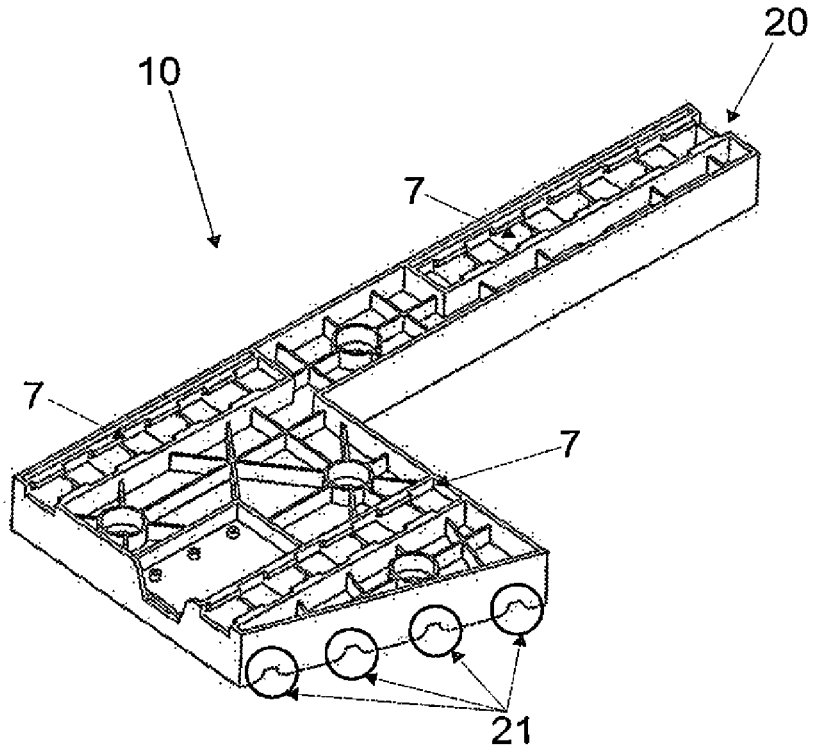
FIG. 10—Is a perspective view of a side rest unit used in the modular upholstered furniture proposed in the present invention.

Accordingly, the description of the compositions comprising the proposed modular furniture is further provided with at least one pair of side rests 10. FIG. 10 is a representation of one of rests 10 used illustrating the portion of it, which is directed to the internal area of the modular furniture, when it has been properly assembled.

It can be seen that the rests comprise sliding runners 7 as well as sliding runners 7 available on seat guide 6 and shown in FIGS. 3 and 4 of the present invention.

It can be seen from FIG. 8 that in this preferred configuration of modular furniture 1, side rest 10 is preferably provided with three sliding runners 7. Each one of runners 7 of rest 10 should be associated with sliding projections 5 of support bases 4, for this purpose, contact face 20 must be supported to the ground, as represented in FIG. 11.

Figure 11:
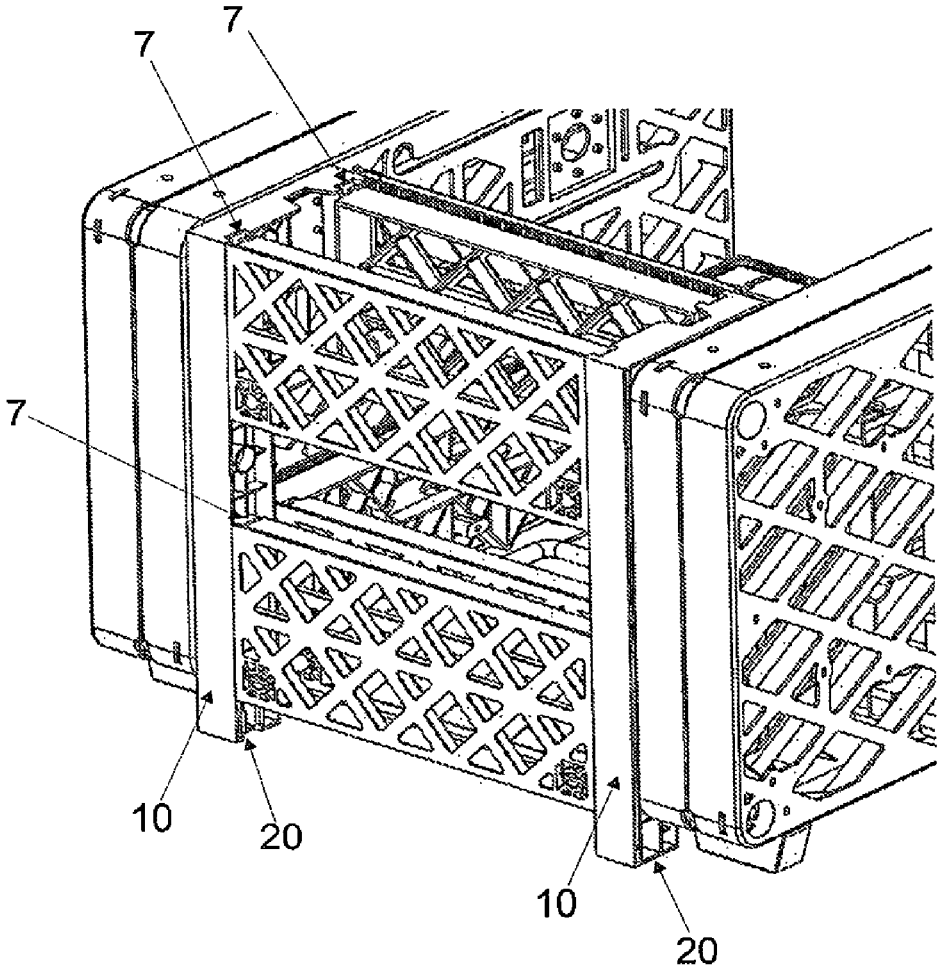
FIG. 11—Is a rear view of the modular upholstered furniture highlighting the side rests and their association with the support bases.

FIG. 11 shows the pair of side rests 10 in which sliding runners 7 for each of these receive support base 4. Thus, four out of five support bases 4 used in this preferred configuration of the present invention are associated/fixed to the pair of side rests 10.

Figure 13:
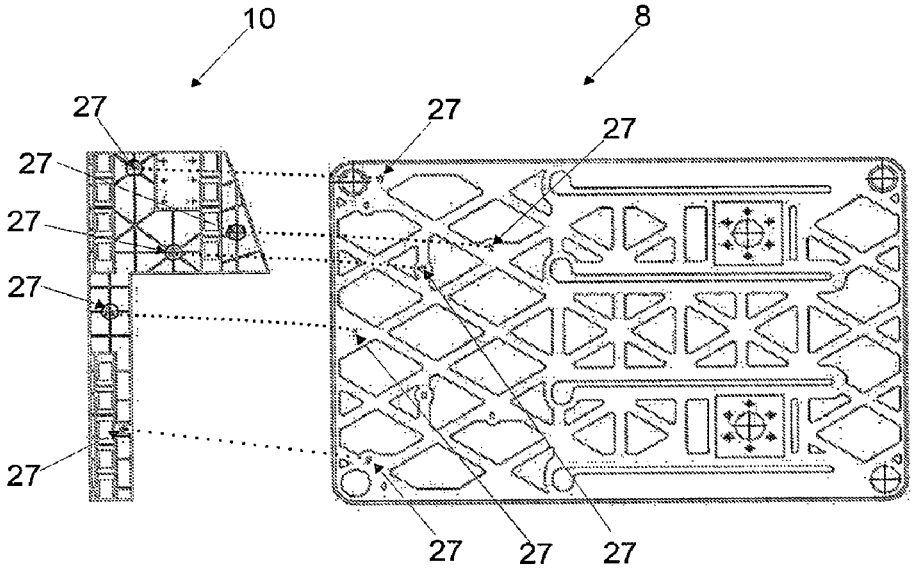
FIG. 13—Is a sectional representation of a support bracket unit and a side rest unit indicating the fixing points between such compositions.

As best seen from FIG. 13, having an "L-shaped" structural form, height G of the narrower portion of side rests 10 preferably corresponds to 60% of their total height H. Furthermore, the depth of the contact face should preferably equal 20% of total depth J of the backrest.

As already mentioned above, the fixing/association of side rests 10 to the other compositions of modular furniture 1 occurs through sliding runners 7 of side rests 10 with sliding projections 5 of support bases 4 and also by the fixing of support brackets 8 with the portion of rests 10 which faces the external area of modular furniture 1.

More specifically, FIG. 13 is a prominent representation of support bracket unit 8 and side rest unit 10, indicating the fixing points between these components.

Preferably, a plurality of connecting holes 27 are available in both side rest 10 and in bracket 8. Thus, fixing elements, such as plastic screws should be used to provide the association and fixing between support bracket 8 and side rest 10.

Figure 12:
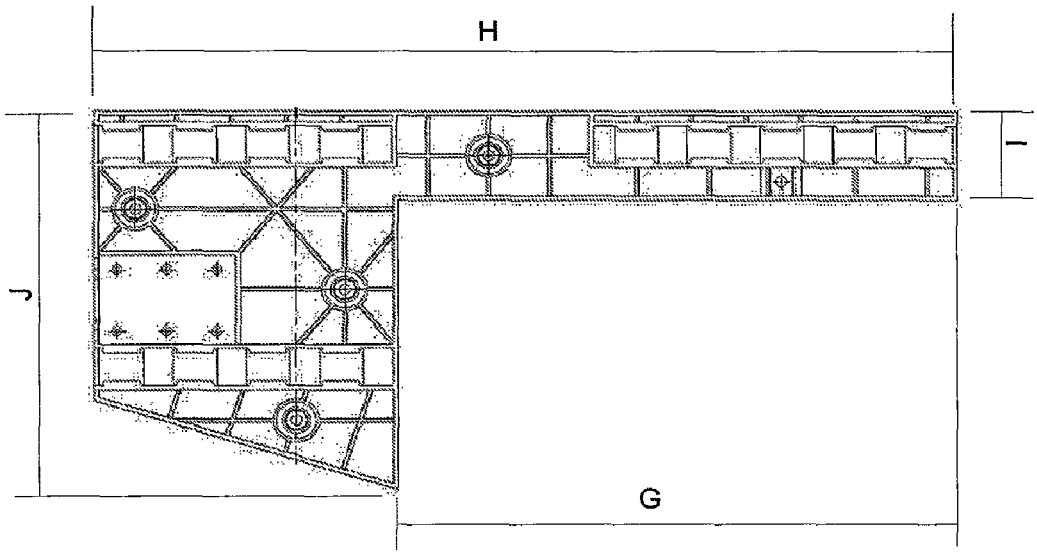
FIG. 12—Is a representation of the structural configuration of the side rest.

The correspondence between connecting holes 27 of brackets 8 and side rest 10 is indicated in FIG. 12 by means of dashed lines; furthermore, to facilitate assembly in the factory, at the point of sale or at the end consumer, butterfly screws are preferably used.

Still in relation to side rests 10, these must be structurally configured so as to enable the attachment/fixing of rest straps, these straps will be in contact with the body of the user (their back) when using modular furniture 1.

Thus, and as can be seen from FIG. 10, the end of the wider portion of side rests 10, whose end is disposed in the inner area of furniture 1, is angularly available in relation to the opposite portion (the portion facing the external area of it).

Thus, the angled portion is comprised of a plurality of recesses 21 for securing at least one backrest strap 22, said backrest strap 22 to be fixed between each of recesses 21 of pair of rests 10 used when forming modular furniture 1.

The availability of backrest straps 22 is best viewed from FIG. 14, a Figure, which shows modular furniture 1 duly mounted—in its front view (FIG. 14 (*a*)) and in its rear view (FIG. 14 (*b*))—including all of the modular compositions described above.

In an alternative configuration, modular furniture 1 can be used without backrest straps 22 and only with support bases 4 secured to the pair of side rests 10. In this way, the backrest (region in which the user supports his back) of the modular furniture will not be so inclined when compared to the configuration in which straps 22 are used.

Thus, this preferred configuration for modular furniture 1 uses two support brackets 8 on each side of furniture 1, two seat guide bases 6, two side rests 10 and five support bases 4 (one in the front and four in the rear portion).

Thus, it can be said that in this preferred configuration of modular furniture 1, the amount of support bases 4 used is equivalent to half of the total amount of sliding runners 7 arranged in each of seat guides 6 and in each side rest 10.

In addition, as can be seen from FIG. 14, support bases 4 used in modular furniture 1, when correctly formed, are arranged in parallel with one another. Seat guides 6 are arranged orthogonally (even if at different heights) in relation to support bases 4.

Furthermore, if desired, it is possible to use fixing feet, support blocks or even a set of castors in the portion of modular furniture 1 in contact with the ground to facilitate the displacement of it.

In addition, as can be seen from FIG. 14 (*a*), said support bar 23 available through comfort extenders 14 of each of seat guides 6, in order to prevent the lateral opening of modular furniture 1.

In order to correctly fix the seat to be used in modular furniture 1, and in reference to FIG. 16, comfort structure 24 should be associated with support bases 4 available at the rearmost and lowermost portion of the furniture (referring to FIG. 14 (*b*) as a later reference).

Figure 15:
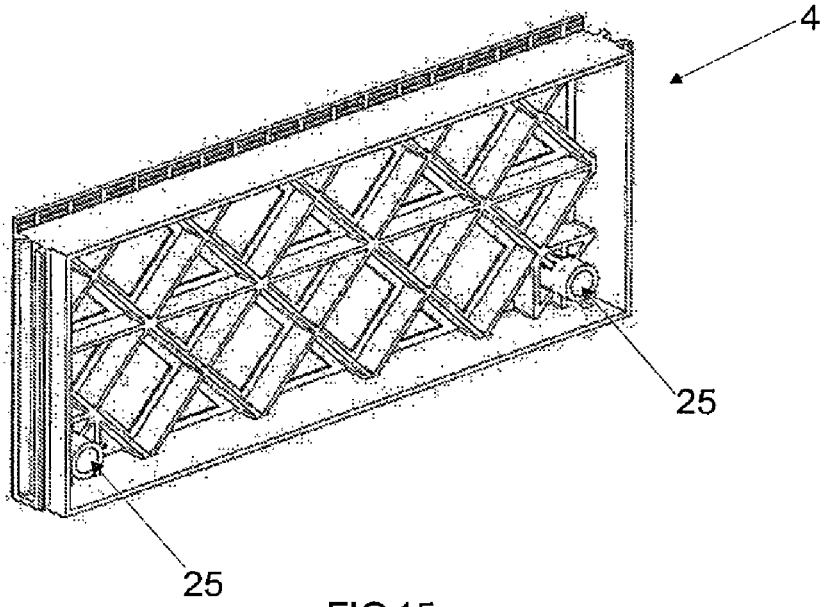
FIG. 15—Is a representation of the portion of the support base that faces the internal area of the modular upholstered furniture.

More specifically, FIG. 17 highlights support bases 4, which should receive comfort structure 24. It can be observed from FIG. 17 (*b*) that structure 24 is initially available at base 4 secured to side rest 10 and passes through-cavity 25 (FIG. 15) of base 4, which is associated with seat guide 6.

Figure 16:
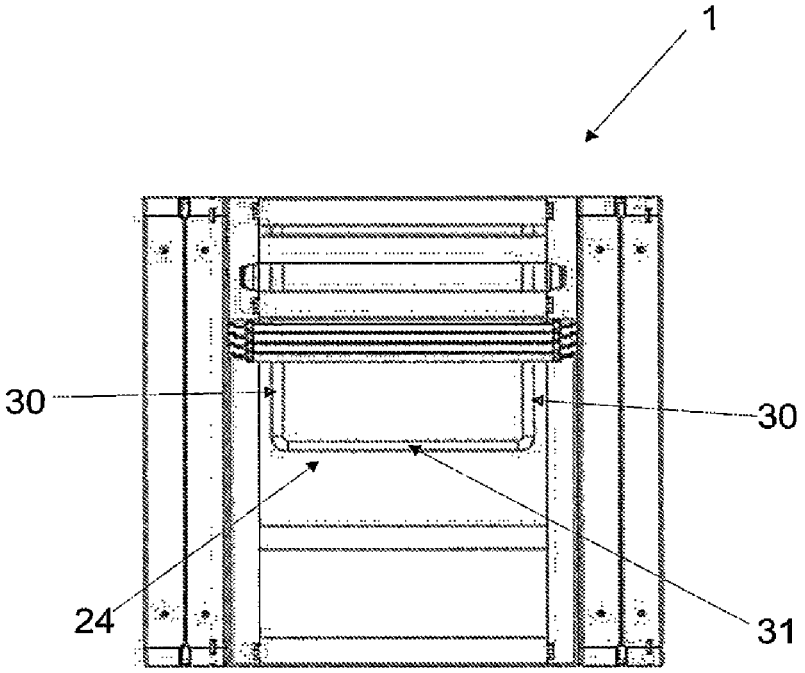
FIG. 16—Is a top representation of the modular upholstered furniture proposed in the present invention, highlighting the comfort structure.

The arrangement of comfort structure 24 is as shown in FIG. 16 for both the configurations, in which the seat is fixed or movable.

Furthermore, in both configurations, a locking element is to be used for securing comfort structure 24 to the support base associated with the pair of side rests 10. The difference between the fixed/mobile seat configuration will reside in the use of a locking element in through-cavity 25 of support base 4 associated with seat guide 6, thereby preventing the displacement of comfort structure 24.

Thus, and in reference to FIG. 16, comfort structure 24 is formed by two parallel frames 30 projecting to the inner area of modular furniture 1 and are interconnected through connection structure 31, said connection structure 31 arranged perpendicularly to parallel structures 30. In this way, when viewed in its top view, support structure 24 takes a U-shaped structural form.

In the configuration in which the seat is fixed, a locking pin (not shown) is to be used to provide the fixing of comfort structure 24 to support base 4, which is associated with seat guide 6.

Thus, the locking pin (not shown) will prevent comfort structure 24 from traveling through cavity 25 of base 4 associated with seat guide 6 and, therefore, the movement of the seat will be prevented. The locking pin may preferably be configured as an Allen bolt or any other fastening element capable of locking comfort structure 24 to support base 4.

Alternatively, in the configuration in which the seat is movable, the locking pin should not be used for the attachment of structure 24 to base 4 associated with seat guide 6. In this case, it is only necessary to lock structure 24 to base 4 associated with rest 10.

Thus, comfort structure 24 will have free displacement through cavity 25 of base 4 associated with seat guide 6, allowing the movement (forward and backward) of the seat to be used in modular furniture 1.

The displacement of the seat will occur on comfort structure 24 and along the length of comfort extender 14, thus enabling the modular furniture to acquire the characteristic of chaise furniture.

In this preferred configuration of the modular unit, each modular composition is manufactured from an injection and extrusion process. Furthermore, one of the advantages of proposed modular furniture 1 lies in the fact that the modular compositions will have the same structural configuration.

For example, all support bases 4 used are the same, as are seat guides 6, rests 10 and support brackets 8. This facilitates production by reducing costs, and it also favors the user by allowing the acquisition of modules to change the configuration of your furniture aesthetically.

Additionally, with proposed modular furniture 1, the problems related to the manufacture and transportation of the furniture currently known in the state of the technique have been overcome.

With the present invention, each modular composition can be delivered separately to both the distributor and the end user, with the simple connection between the parts, as mentioned above, being carried out by those responsible.

Thus, each composition can be delivered/marketed separately in an individual package, making problems related to delivery in places with difficult access incredibly easier.

Furthermore, each modular composition can be separately marketed as a replacement part, thus replacing a composition that has been damaged and preventing the complete exchange of the furniture.

Additionally, if the user wishes to aesthetically alter the composition of their modular furniture 1, they can acquire the necessary compositions to transform, for example, their modular furniture 1 from one place to two places. In this regard, it is to be understood that the preferred description of a one-place modular furniture is not to be considered as a limitation of the present invention.

As mentioned throughout this descriptive report, proposed modular furniture 1 by means of its modular compositions, means of fitting and locking, is capable of conforming furniture for 1 or more places.

Additionally, the covering of modular furniture 1 (and consequently its modular compositions), is preferably carried out by means of a Velcro system (contact fastener) and zipper (closing element), thus facilitating the productive process as well as the maintenance and washing of it, and enabling the user various forms of customization.

Thus, proposed modular furniture 1 allows the actual user themselves to carry out the change of the covering according to their preferential taste or even following variations in trends.

It should also be pointed out that the dimensions mentioned for the modular compositions and for the modular furniture are preferred dimensions and should not be considered as a limitation of the present invention. Obviously, depending on the needs/interests of the client, the compositions used could have dimensions different from those described.

Furthermore, although this preferred configuration of the modular system has substantially referred to sliding projections and sliding runners for the association between the modular compositions, it should be understood that other forms of fixing could be used.

For example, the fixing elements could be configured as pressure elements, sliding elements, cross-members and connecting pins (preferably plastic).

Basically, the scope of the present invention incorporates any element for fixing with a of cooperative structural form and capable of providing the association between the compositions of the modular furniture.

Having described a preferred example for configuration, it should be understood that the scope of the present invention encompasses other possible variations, being limited only by the content of the appended claims, including equivalent possibilities.

The invention claimed is:

1. Modular upholstered furniture (1) formed by a plurality of modular compositions substantially composed of polymeric material, the modular upholstered furniture (1) wherein:

the modular compositions are associable with each other through at least one fixing element available in each of the modular compositions, so that distinct modular compositions have structurally cooperative fixing elements to provide for the association of the modular compositions and a formwork of the modular furniture (1), the modular compositions are comprised of:

a set of support bases (4) provided with a pair of sliding is projections (5) configured for removably connecting each of the support bases (4) with at least one pair of seat guides (6) or at least one pair of side rests (10), wherein:

the seat guides (6) are each comprised of a respective elongated opening and sliding runners (7), the sliding runners (7) configured for removably receiving the sliding projections (5) of the support bases (4), furthermore:

the pair of side rests (10) are also provided with additional sliding runners (7) configured for removably receiving the sliding projections (5) of the support bases (4), and a set of support brackets (8), each of the support brackets (8) being removably attached to at least each one of the side rests (10) and inner ones of the support brackets (8) on opposing lateral sides of the modular furniture are removably interconnected with each other by a support bar (23), wherein the support brackets (8), side rests (10), support bar (23), and the support bases (4) that are connected to the side rests (10) form a seat back and sides portion of the modular furniture (1), and wherein the seat guides (6) and the support bases (4) that are connected to the seat guides (6) form a seat bottom portion of the modular furniture (1), and wherein the support bar (23) is slidably received through respective ones of the elongated openings in the seat guides (6) for enabling fore and aft sliding of the seat bottom portion relative to the seat back and sides portion of the modular furniture (1).

2. Modular upholstered furniture (1) according to claim 1, wherein elements for removably connecting the support bases (4) to the seat guides (6) and the side rests (10) are configured as at least one of the following elements: pressure elements, sliding elements, connecting rods and connecting pins.

3. Modular upholstered furniture (1) according to claim 1, wherein the sliding projections (5) are located along smaller sized sides of the support bases (4) and are configured as collars protruding from the lateral ends of the support base (4).

4. Modular upholstered furniture (1) according to claim 3, wherein the sliding runners (7) are arranged on a portion of seat guides (6) and the additional sliding runners (7) are arranged on the side rests (10), each of the sliding runners and additional sliding runners facing an inner area of modular furniture (1), and each sliding runner (7) and each additional sliding runner is provided with a track (13) capable of removably fixing the sliding projections (5).

5. Modular upholstered furniture (1) according to claim 4, wherein sliding runners (7) are configured as cutouts in the portion of seat guides (6) facing the inner area of modular furniture (1); furthermore, the sliding runners extend substantially along an entire height of seat guide (6) and further comprise a plurality of clamps (18), said clamps (18) providing widths for the sliding runner (7) that are slightly less than a maximum width of the sliding projections (5).

6. Modular upholstered furniture (1) according to claim 5, wherein each seat guide (6) is comprised of a comfort extender (14) comprising a respective one of the elongated openings and configured as a longitudinally-profiled area on each seat guide (6), the comfort extender (14) allowing the displacement of at least one seat comprising the seat bottom portion along its profiled area.

7. Modular upholstered furniture (1) according to claim 6, wherein the side rests (10) are comprised of an "L" shape, wherein the height (G) of a relatively narrower portion of rests (10) is between 50% and 60% of a total height (H) of the side rests (10).

8. Modular upholstered furniture (1) according to claim 7, wherein a relatively wider portion of the side rests (10) is angularly tapered in relation to the narrower opposite portion, said wider portion also comprising a plurality of recesses (21) for securing at least one rest strap (22).

9. Modular upholstered furniture (1) according to claim 8, further comprising at least one comfort structure (24) removably connected with at least one of the support bases (4), the comfort structure (24) formed by at least two parallel structures (30) that project into the internal area of the modular furniture and that are interconnected by a connecting structure (31).

10. Modular upholstered furniture (1) according to claim 9, wherein a sliding surface of the comfort structure 24 moves along an inner surface of one of the portions of the modular furniture (1) while a connecting end of the comfort structure (24) remains fixed relative to the at least one of the support bases (4) of the other portion of the modular furniture.

11. Modular upholstered furniture (1) according to claim 9, wherein a locking element is arranged in a place of contact between the comfort structure (24) and one of support bases (4), the locking is element thus establishing a fixed configuration for comfort structure (24).

12. Modular upholstered furniture (1) according to claim 11, wherein support base (4), seat guide (6), side rest (10) and support bracket (8) are manufactured by a process of injection and extrusion.

13. Modular upholstered furniture (1) according to claim 12, wherein support base (4) comprises a rectangular shape, in which a length of the support base (4) is at least double a value of a height of the support base (4); furthermore, a length of the seat guide (6) is about four times a value of a height of the support base (4).

14. Modular upholstered furniture (1) according to claim 13, further comprising:

the pair of seat guides (6) arranged parallel to each other and associated with a pair of support bases (4) of the set of support bases (4) by the sliding projections (5) arranged on the support bases (4) and a pair of the sliding runners (7) arranged on each of seat guides (6), the set of support brackets (8) comprising two pairs of support brackets (8), each pair of the support brackets (8) located at one end of modular furniture (1), each pair of the support brackets (8) comprised of support brackets (8) associable with each other and wherein one of the support brackets (8) of each pair of the support brackets (8) is also associated with a side rest (10) from the pair of side rests (10), each side rest (10) of the pair of side rests (10) positioned at a lateral end of the modular furniture (1), each side rest (10) further comprising three of the sliding runners (7) for removable connection of the side rests (10) to the support bases (4), and a number of the support bases (4) in the modular furniture (1) being equivalent to half of a number of the sliding runners (7) on the seat guides (6) and the side rests (10).

15. Modular upholstered furniture (1) according to claim 14, wherein the support bases (4) used in the modular furniture (1) are arranged parallel to each other and the seat guides (6) are orthogonally arranged in relation to the support bases (4).

* * * * *